US012495859B2

(12) United States Patent
Qin

(10) Patent No.: US 12,495,859 B2
(45) Date of Patent: Dec. 16, 2025

(54) FOOTWEAR

(71) Applicant: Daimatu inc., Shizuoka (JP)

(72) Inventor: Jianzhong Qin, Shizuoka (JP)

(73) Assignee: Daimatu inc., Shizuoka (JP)

( * ) Notice: Subject to any disclaimer, the term of this patent is extended or adjusted under 35 U.S.C. 154(b) by 0 days.

(21) Appl. No.: 18/539,294

(22) Filed: Dec. 14, 2023

(65) Prior Publication Data

US 2024/0260707 A1 Aug. 8, 2024

(30) Foreign Application Priority Data

Feb. 2, 2023 (JP) ..... 2023-014517

(51) Int. Cl.
*A43B 11/02* (2006.01)

(52) U.S. Cl.
CPC ..... *A43B 11/02* (2013.01)

(58) Field of Classification Search
None
See application file for complete search history.

(56) References Cited

U.S. PATENT DOCUMENTS 2,942,359 A * 6/1960 Bushway ..... A43B 5/10 36/105
4,451,996 A * 6/1984 Norton ..... A43B 5/00 36/129
4,559,722 A * 12/1985 Norton ..... A43B 23/0235 36/105
8,215,036 B2 * 7/2012 Auger ..... A43B 7/16 36/105
10,342,289 B2 * 7/2019 Bell ..... A43B 23/027
D992,888 S * 7/2023 Weeks ..... D2/972
2010/0319218 A1 12/2010 Auger et al.
2017/0196309 A1 7/2017 Ferguson

FOREIGN PATENT DOCUMENTS

JP S57189401 U 12/1982
JP H09206107 A 8/1997
JP 2005000333 A 1/2005
JP 3122770 U 6/2006
JP 3235968 U 1/2022
JP 2022139151 A 9/2022

OTHER PUBLICATIONS

Office Action in KR Application No. 10-2023-0163046, dated Jun. 24, 2025. 9pp.

* cited by examiner

*Primary Examiner* — Jila M Mohandesi
(74) *Attorney, Agent, or Firm* — HAUPTMAN HAM, LLP

(57) ABSTRACT

A footwear has a heel, a protruding portion with a core protruding above a topline of the heel, and the protruding portion has first and second mountain portions on both sides and a valley portion between the first mountain portion and the second mountain portion, respectively. The footwear has a first guiding portion formed on the inside of the footwear of the first mountain to guide a heel of the foot into the footwear, and a second guiding portion formed on the inside of the footwear of the second mountain to guide the heel of the foot into the footwear.

9 Claims, 15 Drawing Sheets

FOOTWEAR

RELATED APPLICATION

The present application claims priority to Japanese Application Number 2023-14517 filed Feb. 2, 2023, the disclosure of which is hereby incorporated by reference herein in its entirety.

TECHNICAL FIELD

This invention relates to footwear, and in particular to footwear that can be worn without crushing the heel.

BACKGROUND TECHNOLOGY

Conventionally, for example, there are footwear having a heel portion at the rear end, as described in Japanese published patent number JP 2022-139151A.

This footwear has a rigid protrusion at the upper end of the heel portion that extends obliquely upward and backward, and the protrusion is provided with a moon-shaped core extension extended from the moon-shaped core provided in the heel portion as a core to obtain hardness.

However, in the above-mentioned footwear , there is a hard piece of buttock at the upper end of the heel that extends diagonally upward and backward.

When putting on the shoes, the heel of the foot touches the protrusion, and the heel of the shoe is small, making it difficult to insert the heel.

The heel part of the shoe is small, making it difficult to insert the heel of the shoe into the shoe.

The problem was that the heel of the shoe was too small to fit into the heel of the shoe.

It is an object of the present invention to provide footwear made in consideration of the above-mentioned problems.

SUMMARY

Problems to be Solved

Means for Solving Problems

A footwear according to at least one embodiment includes a heel portion, wherein a protruding portion including a core protruding above a top line of the heel portion is attached to the heel portion, the protruding portion is formed with a first mountain portion and a second mountain portion on both sides, and a valley portion between the first mountain portion and the second mountain portion, a first guide portion for guiding a heel of a foot to an inside of the footwear is formed on a footwear inner side of the first mountain portion, and a second guide portion for guiding the heel of the foot to the inside of the footwear is formed on a footwear inner side of the second mountain portion.

Further, according to the footwear according to at least one embodiment includes, the protruding portion is formed with a reinforcing core and a covering member covering the reinforcing core through a sponge member, the reinforcing core is provided with a core valley portion at a center of an upper end of a core body, and formed with a first mountain portion core on one side of the core valley portion and a second mountain portion core on the other side of the core valley portion, and the core of the protruding portion is harder than the sponge member.

Further, according to the footwear according to at least one embodiment includes, the first guide portion and the second guide portion are facing each other and inclined to widen outwardly Further, according to the footwear according to at least one embodiment includes, the first mountain portion is inclined upwardly and obliquely outward, and the second mountain portion is inclined upwardly and obliquely outward.

Further, according to the footwear according to at least one embodiment includes, from a front view of the heel portion, the valley portion is positioned at a center, the first mountain portion is positioned at right, and the second mountain portion is positioned at left, and the first guide portion and the second guide portion are facing each other and inclined to widen outwardly.

Effects

According to the footwear according to at least one embodiment, the heel part is guided by the inside of the first guide portion and the inside of the second guide portion to be smoothly introduced into the footwear, and can be put on without a shoehorn by preventing the heel part from being crushed.

DETAILED DESCRIPTION

An example of footwear of the present invention will be described with reference to the drawings (FIGS. 1 to 15).

Figure 1:
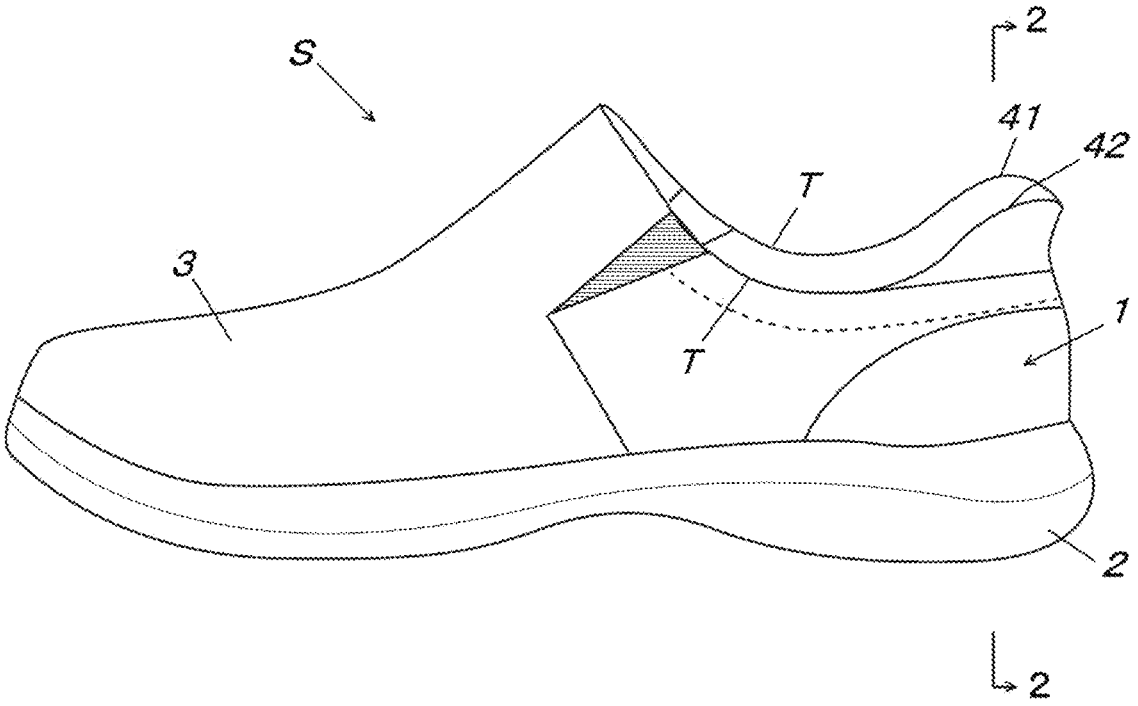
FIG. 1 is a schematic front view of a footwear according to at least one embodiment of the present application.
Figure 6:
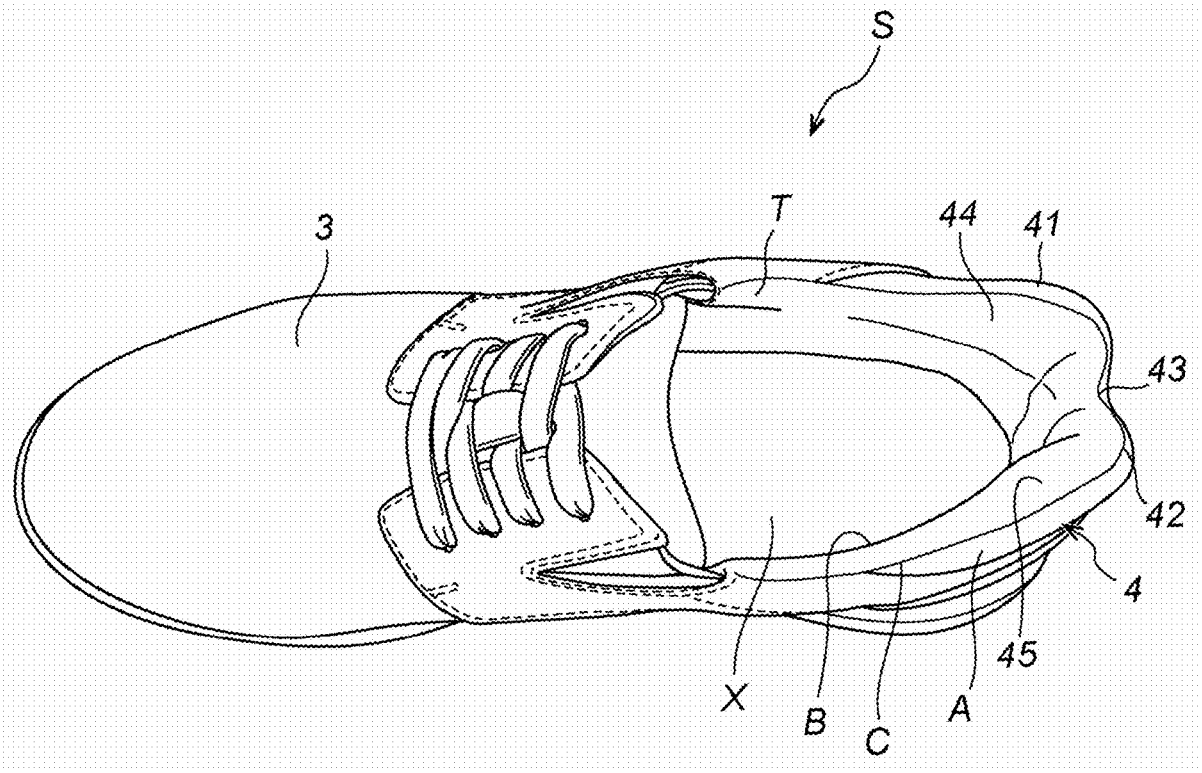
FIG. 6 is a photograph taken from above of an example of the footwear embodiment of FIG. 1.

S shown in FIGS. 1 and 6 is a footwear having a heel 1. The footwear (e.g., short shoes) S has a sole 2 and an upper 3.

A protruding portion 4 is a protrusion with a core protruding above the topline T of the heel 1. The protrusion 4 is made of a material that becomes a core 40, e.g., an internal core, a hard core, a reinforcing member, commonly known as a counter or a moon-shaped core 40, between the outer material A and the inner material B of the footwear S, and between the core 40 and the inner material B of the footwear S, a sponge member (sponge cushion) 46 is positioned between the core 40 and the inner material B of the footwear S.

Figure 7:
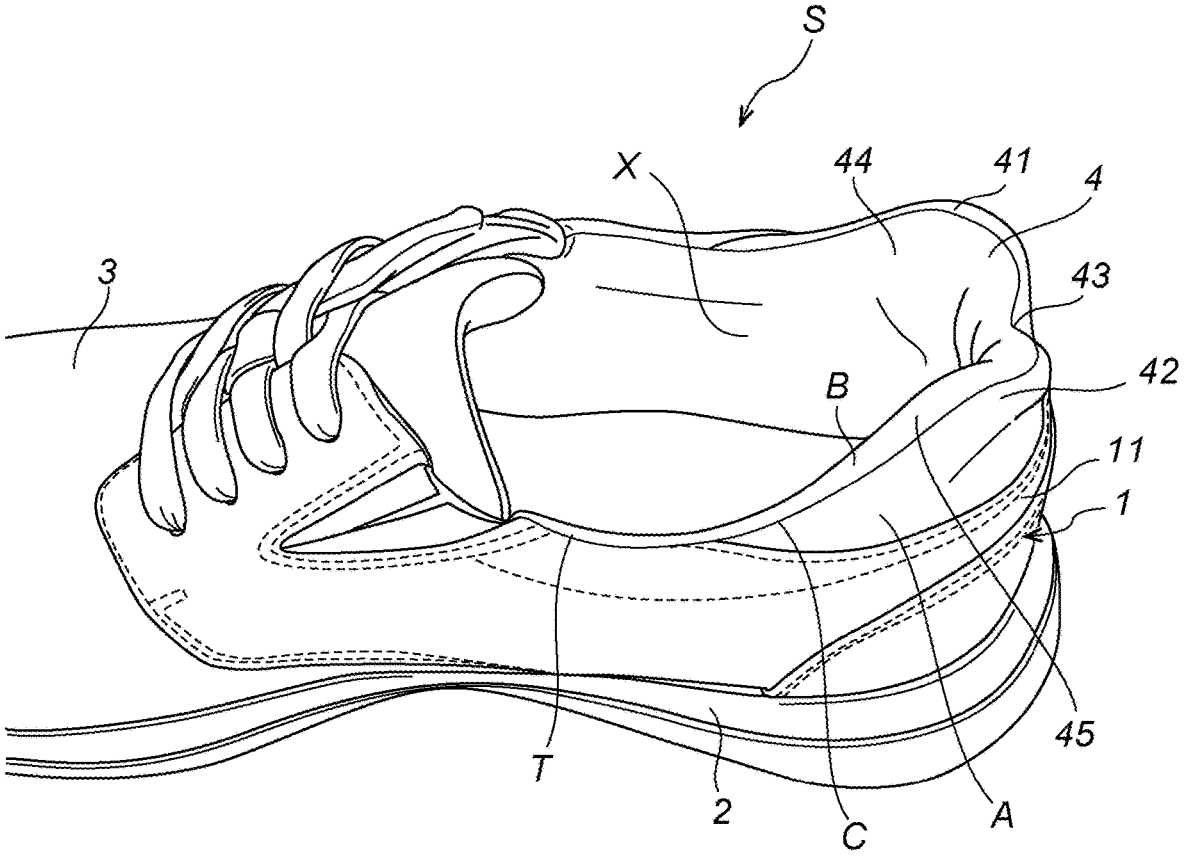
FIG. 7 is a photograph of the heel of the footwear shown in FIG. 6 taken from diagonally above.

The core 40 of the protruding portion 4 is harder than the outer material A of the footwear S, the inner material B of the footwear S, and the sponge member 46, and the protrusion 4 is attached to the heel 1, for example by sewing. C shown in FIGS. 6 and 7 is the sewn portion of the outer material A of the footwear S and the inner material B of the footwear S.

The protrusion 4 has first and second mountain portion 41 and 42 on both sides, and a valley portion 43 between the first mountain portion 41 and the second mountain portion 42, respectively. In other word, a protruding portion 4 includes the core 40 protruding above a top line T of the heel portion is attached to the heel portion and the protruding portion 4 is formed with a first mountain portion 41 and a second mountain portion 42 on both sides, and a valley portion 43 between the first mountain portion 41 and the second mountain portion 42. The first mountain portion 41 is inclined upwardly and obliquely outward, and the second mountain portion 42 is inclined upwardly and obliquely outward.

As discussed further below, the protruding portion 4 is formed with a reinforcing core 40 and a covering member A,B covering the reinforcing core 40 through a sponge member 46, the reinforcing core 40 is provided with a core valley portion 401A at a center of an upper end of a core body 401, and formed with a first mountain portion core 401B on one side of the core valley portion 401A and a second mountain portion core 401C on the other side of the core valley portion 401A, and the core 401 of the protruding portion 4 is harder than the sponge member 46.

The protruding portion 4 has a first guiding portion (shoe counter lining material) 44 guiding the heel 5 of the foot into the footwear S and a second guiding portion (shoe counter lining material) 45 guiding the heel 5 of the foot into the footwear S on the inside X of the first mountain portion 11 and on the inside X of the second mountain portion 42, respectively.

Figure 2:
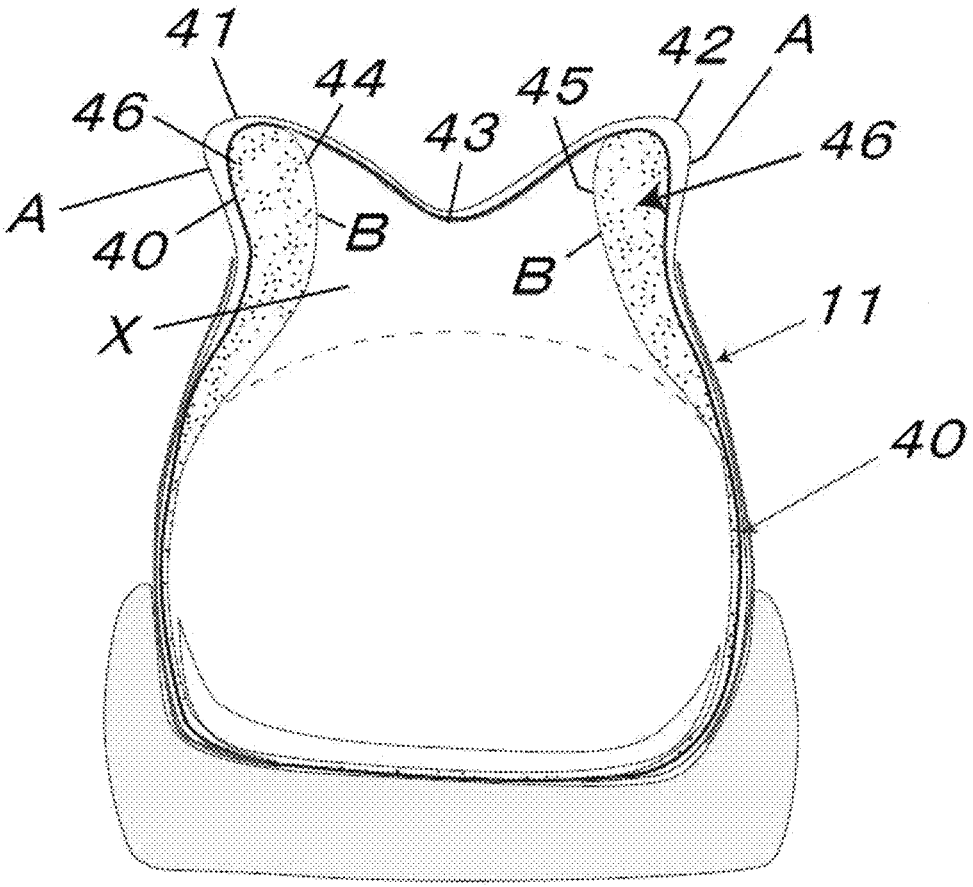
FIG. 2 is a schematic cross-sectional view taken along the line 2-2 in FIG 1.
Figure 3:
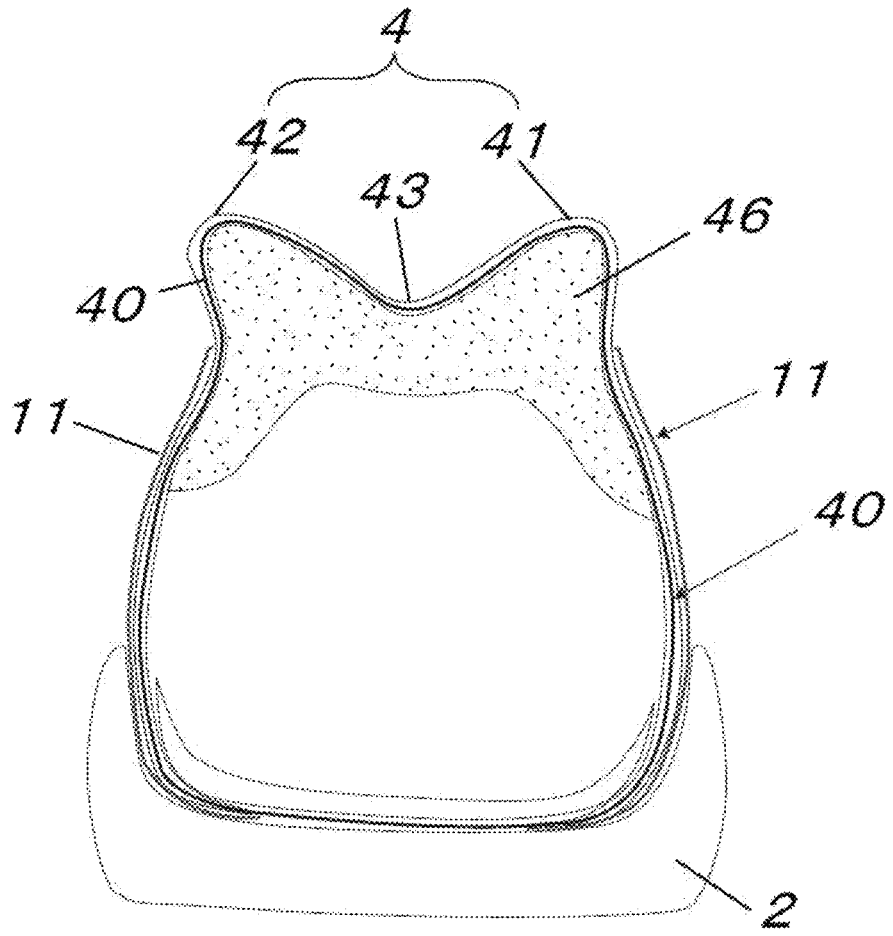
FIG. 3 is is a schematic right-side partial cross-sectional view of the footwear of FIG. 1 with the upper surface member stripped FIG. 3.
Figure 4:
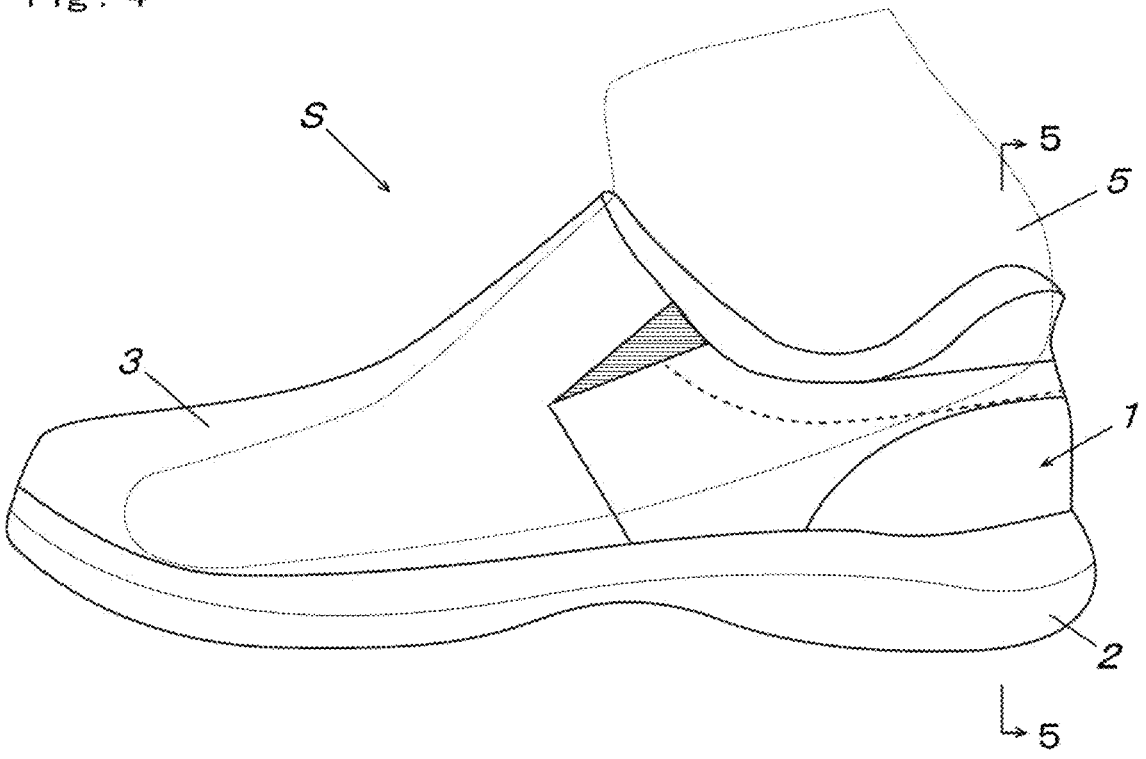
FIG. 4 is a schematic front view of the footwear of FIG. 1 in a worn state.
Figure 5:
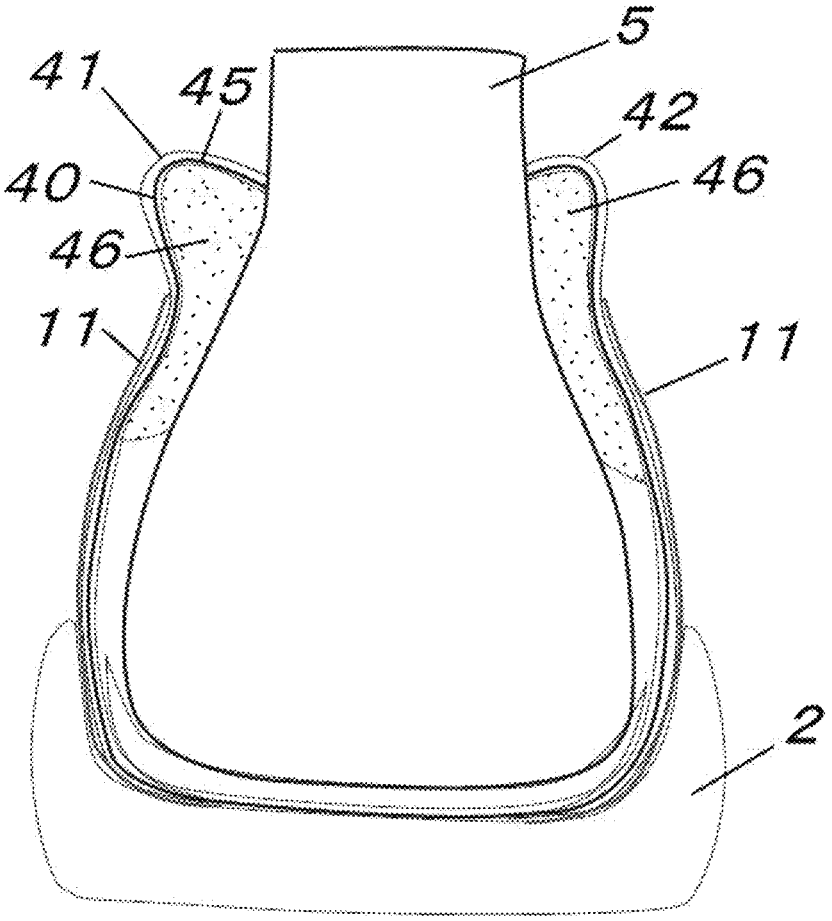
FIG. 5 is a schematic cross-sectional view taken along the line 5-5 in FIG. 4.
Figure 8:
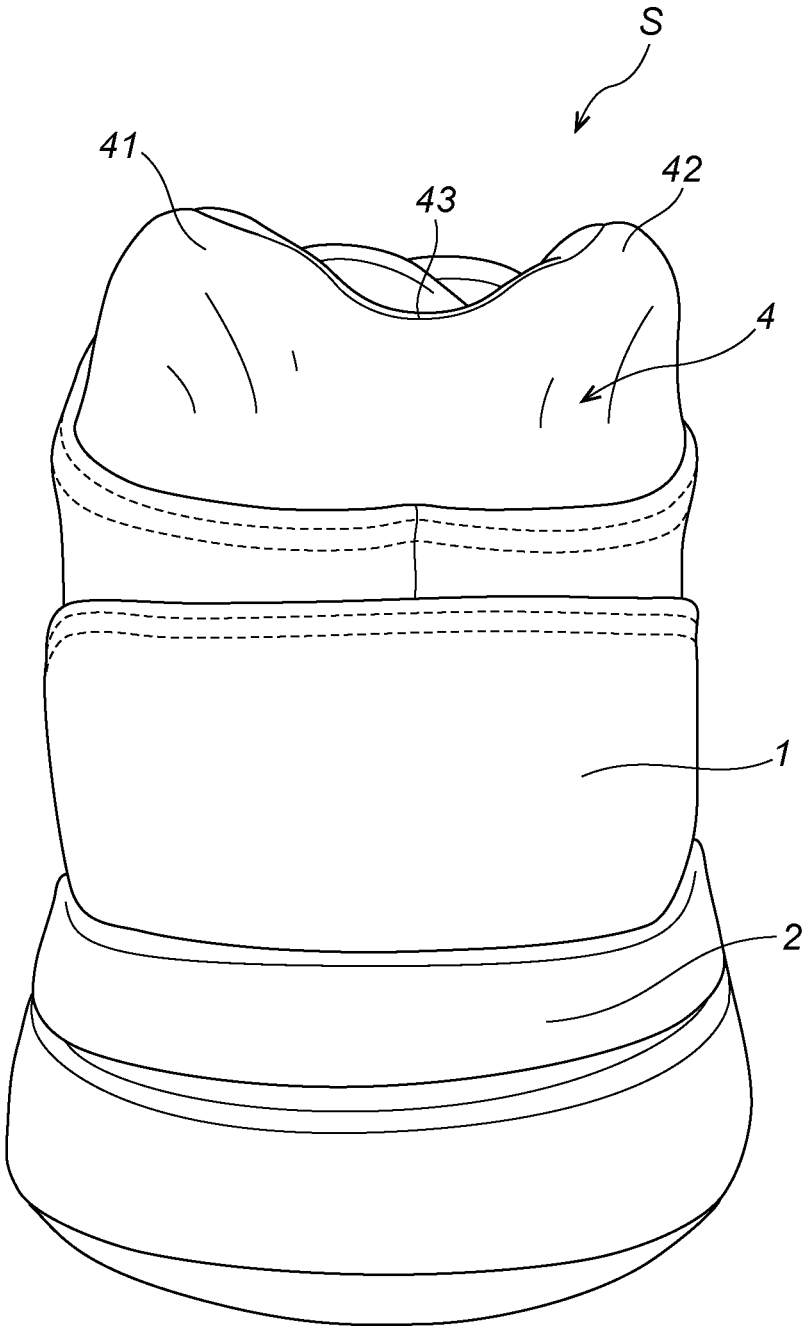
FIG. 8 is a photograph of the heel of the footwear in FIG. 6 as the front view.

The first mountain portion 41 slopes upwardly and diagonally outwardly (FIGS. 2 and 10), the second mountain portion 42 slopes upwardly and diagonally outwardly (FIGS. 2 and 9), and the front view of the heel 11, the valley portion 43 is centered, the first mountain portion 41 on the right and the second mountain portion 42 on the left (FIGS. 2 and 8).

Figure 9:
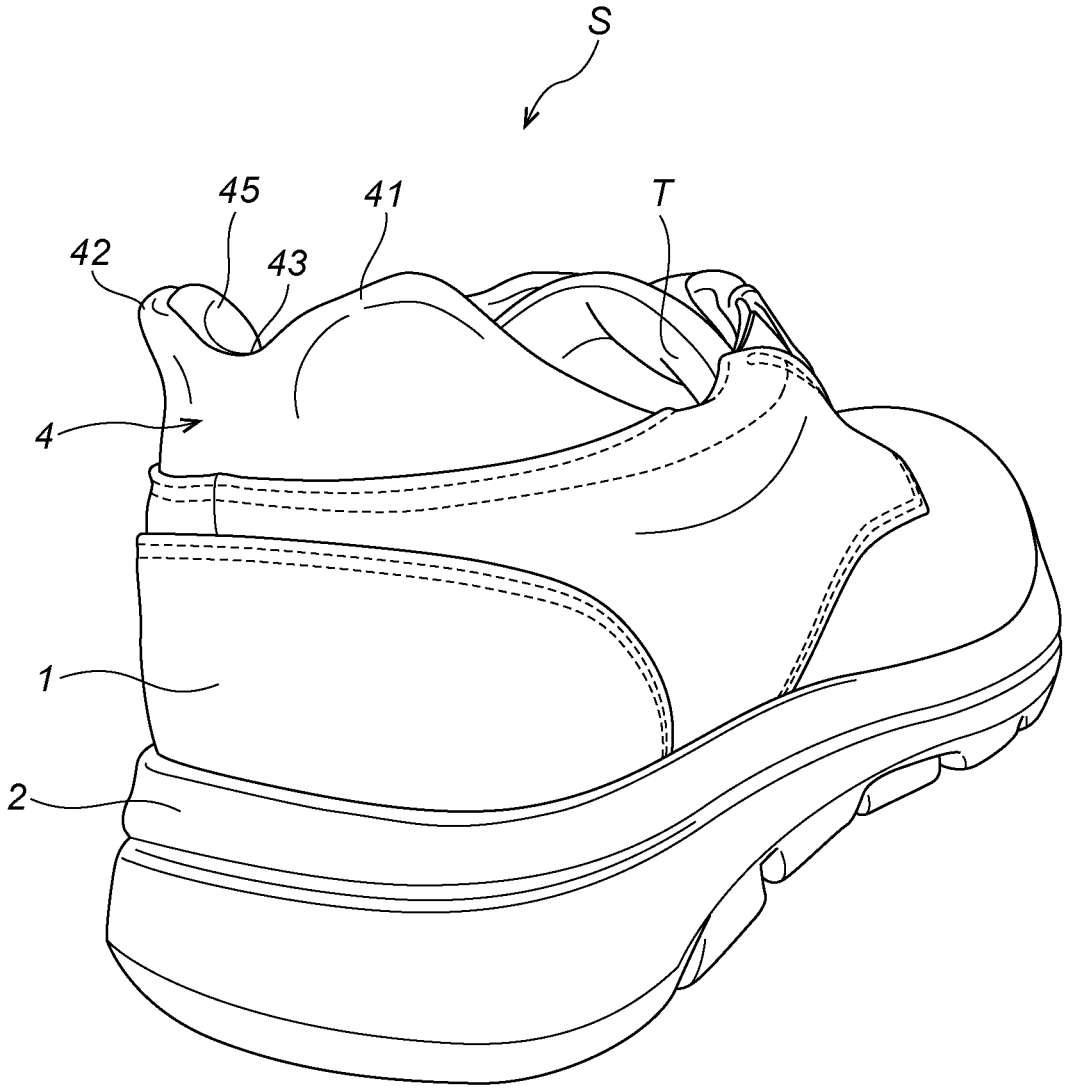
FIG. 9 is a photograph taken diagonally looking at the heel of the footwear shown in FIG. 6.
Figure 10:
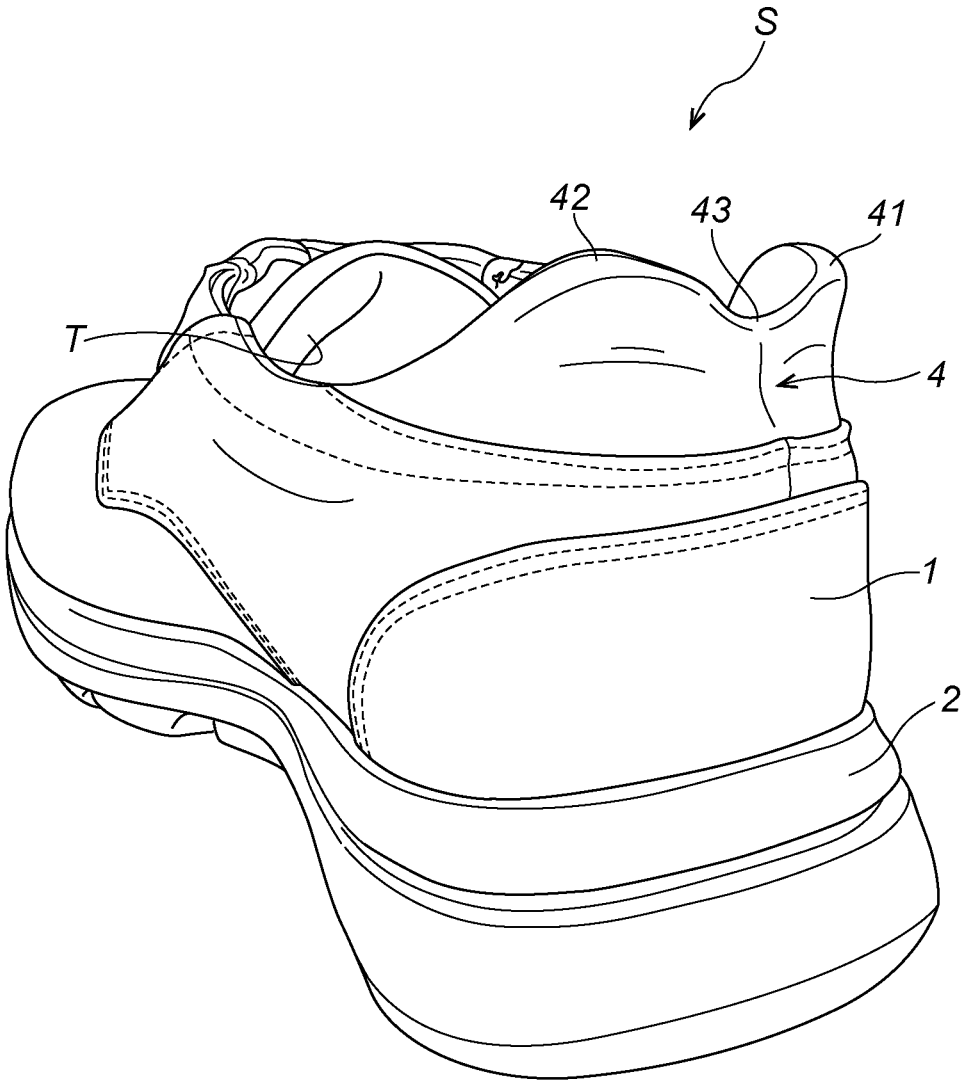
FIG. 10 is a photograph of the heel of the footwear in FIG. 6 from a different direction than FIG. 9.
Figure 11:
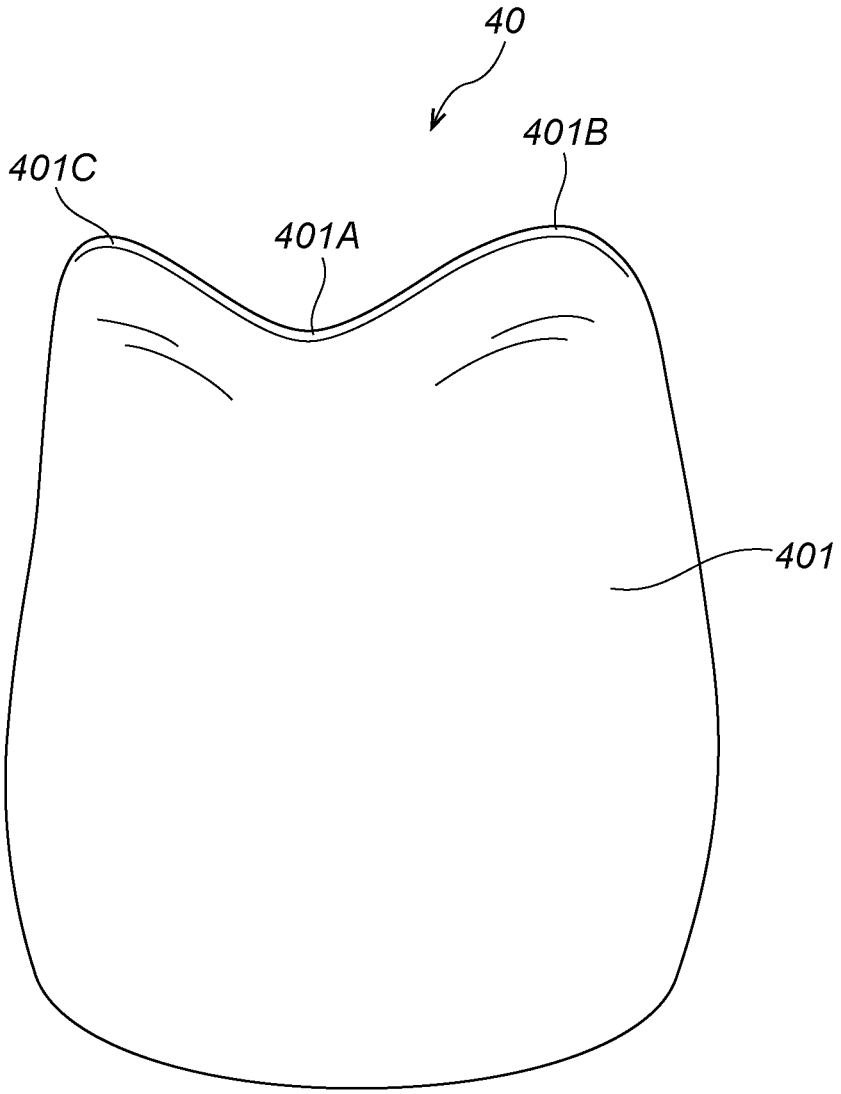
FIG. 11 is a photograph of the core (counter) inherent in the heel of the footwear shown in FIG. 6.
Figure 12:
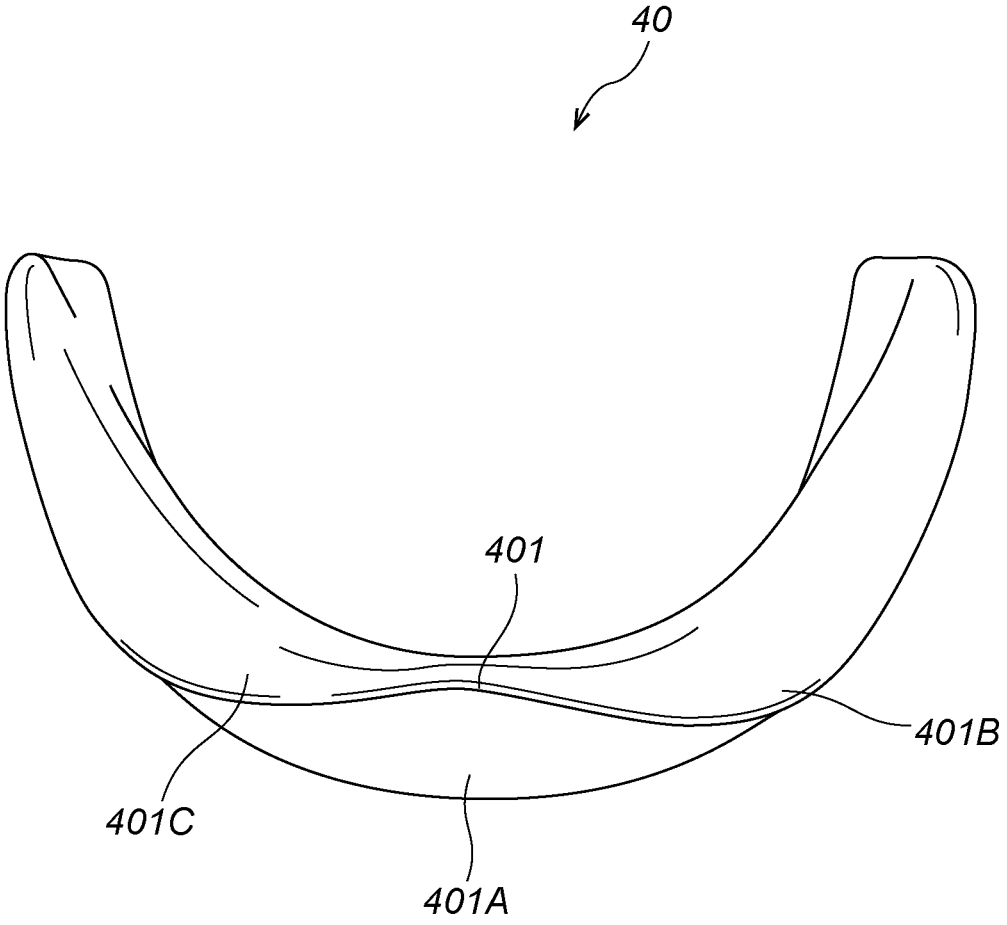
FIG. 12 is a photograph of the core (counter) in FIG. 11 taken from above.
Figure 13:
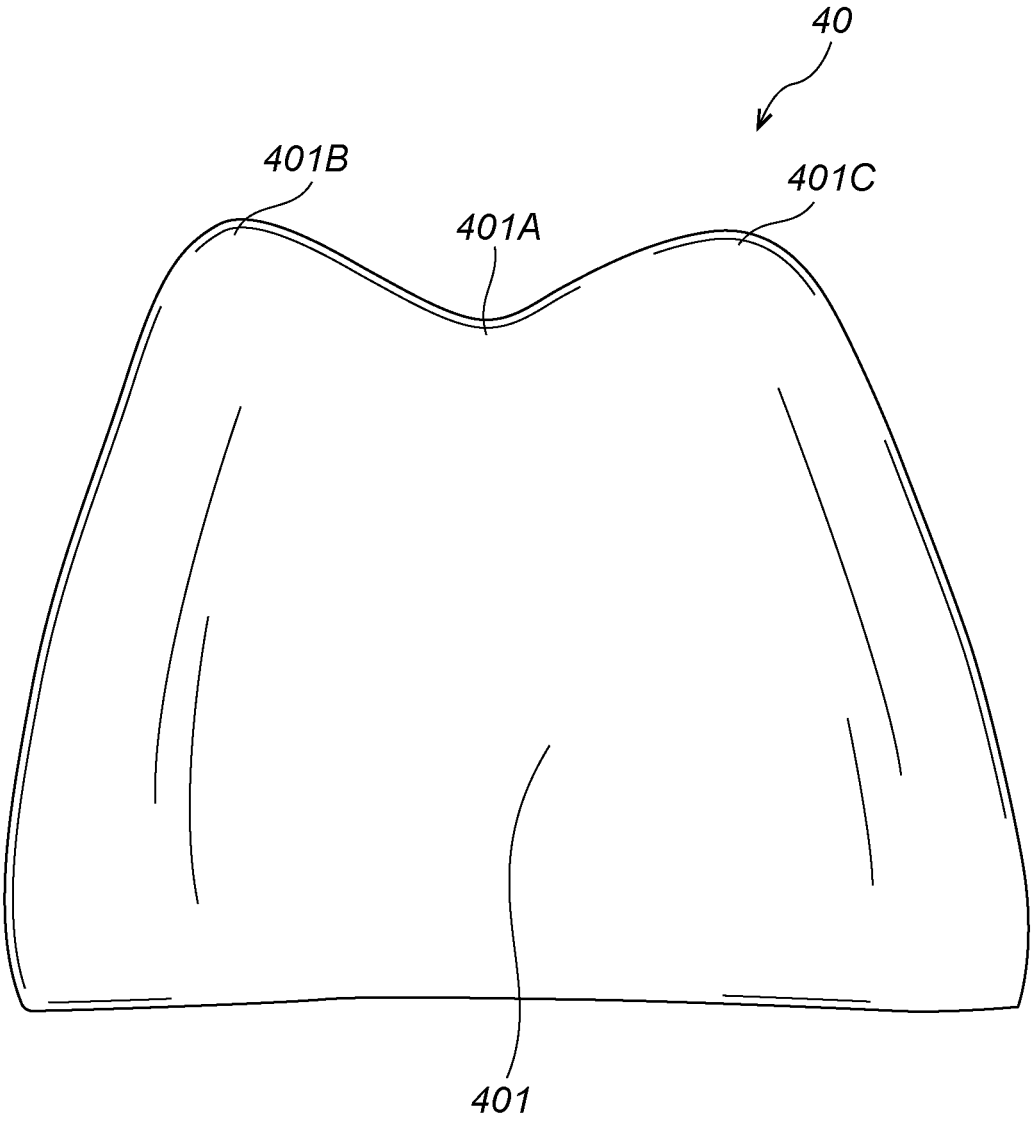
FIG. 13 is a photograph of the core (counter) in FIG. 11 taken from the rear side.
Figure 14:
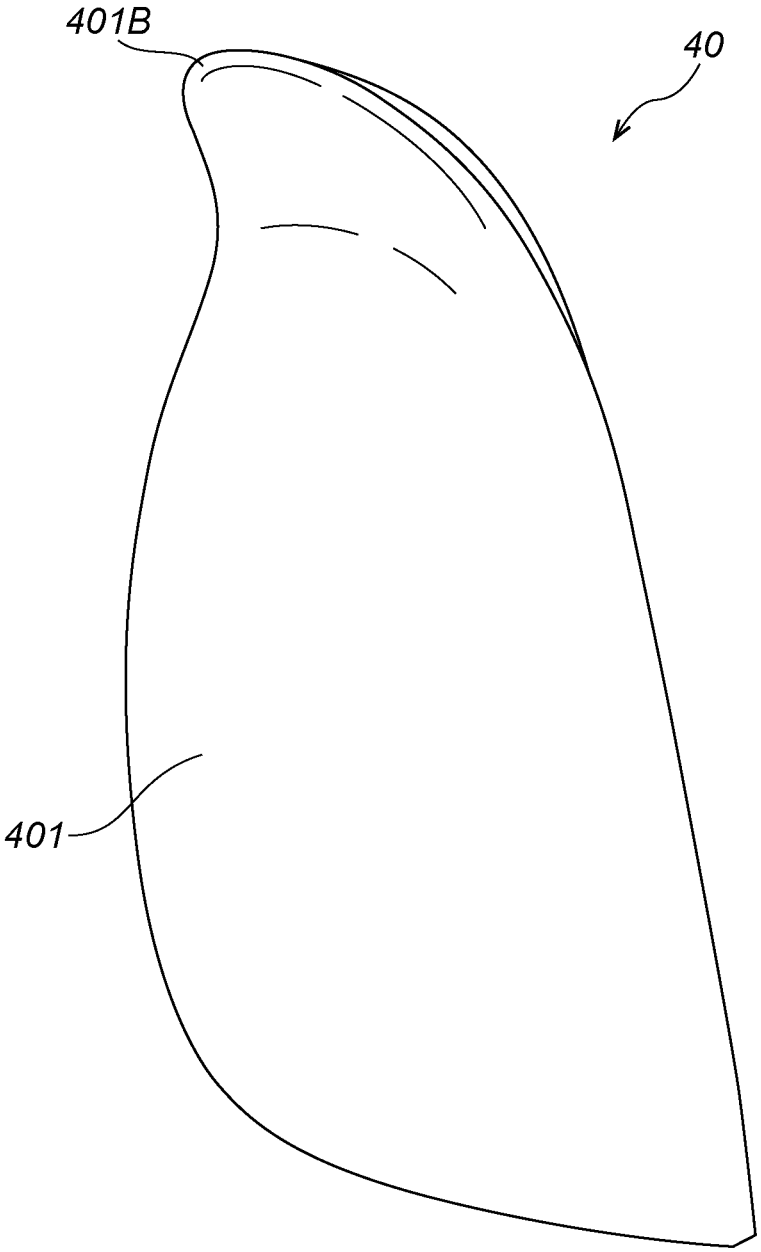
FIG. 14 is a photograph of the core (counter) in FIG. 11 taken from the right side.
Figure 15:
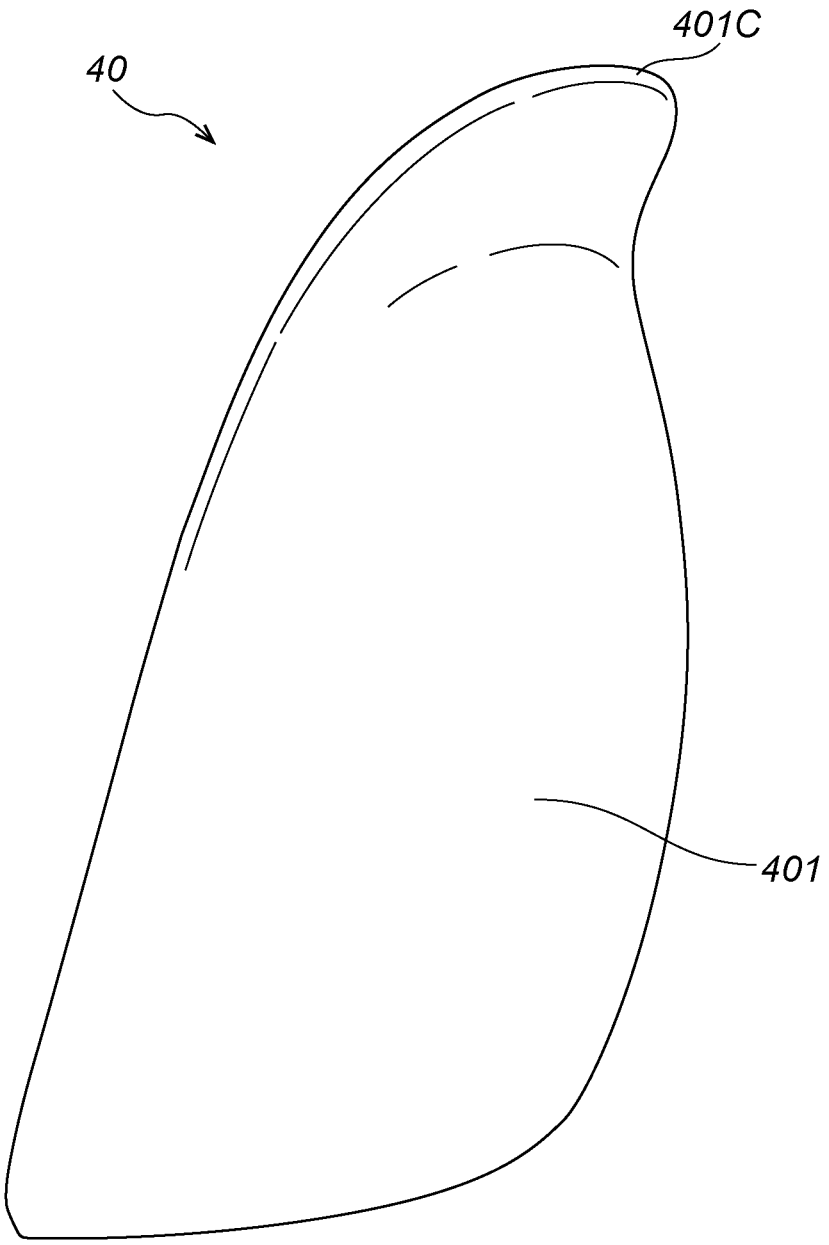
FIG. 15 is a photograph of the core (counter) in FIG. 11 taken from the left side.

The first mountain portion 41 slopes upward and diagonally outward (FIGS. 2 and 10), and the second mountain portion 42 slopes upward and diagonally outward (FIGS. 2 and 9).

In other words, a first guide portion 44 for guiding a heel of a foot 5 to an inside of the footwear is formed on a footwear inner side of the first mountain portion 41 , and a second guide portion 45 for guiding the heel of the foot 5 to the inside of the footwear is formed on a footwear inner side of the second mountain portion 45.

When viewed from the front, the valley portion 43 is located at the center, the first mountain portion 41 is located on the right, and the second mountain portion 42 is located on the left (FIGS. 2 and 8). The part of the sole of the foot corresponding to the heel 5 is the trough 43, and the heel 5 comes into contact with the first and second mountain portion 41 and 42 located on both sides of the trough 43, so that the heel 5 of the foot is in contact with the footwear S.

In other words, from a front view of the heel portion, the valley portion 43 is positioned at a center, the first mountain portion 41 is positioned at right, and the second mountain portion 42 is positioned at left, and the first guide portion 44 and the second guide portion 45 are facing each other and inclined to widen outwardly.

The heel 5 of the foot that has entered the footwear S comes into contact with the first mountain portion 41 and the second mountain portion 42, and the heel 5 of the foot that comes into contact with the inside of the first mountain portion 41 It is guided by the inside of the second mountain portion 42 and slips into the footwear S.

The shoes can be worn without using a shoe horn by being guided by the user's movements and without crushing the heel part 1.

The protrusion 4 also includes a core 40 and a cover member that covers the core 40 via a sponge member (sponge cushion) 46 [a member that covers the core 40 and the sponge member (sponge cushion) 46, e.g. Material A on the outside of footwear S and material B on the inside of footwear S are integrated at sewing part C. (FIG. 6, FIG. 7).

The core (counter) 40 is a reinforcing core inserted between the shoe upper surface member of the heel portion 1 of the footwear S and the shoe counter lining material.

As shown in FIGS. 11 to 15, the core 40 includes a core main body 401 (covering the heel of the foot) and a core in the center of the upper end of the core main body 401 (covering the heel of the foot).

A valley portion 401A is provided, a first mountain portion core 401B is provided on one side of the core valley portion 401A, and a second mountain portion core 401C is provided on the other side of the core valley portion 401A. each formed.

The core 40 is harder than the outer material A of the footwear S, the inner material B of the footwear S, and the sponge member 46.

In particular, the core 40 has a core valley 401A provided at the center of the upper end of the core main body 401, and a first mountain portion core 401B on one side of the core valley 401A. Since the second mountain portion core 401C are formed on the other side of the core valley portions, the "footwear S having a heel portion 1, which protrudes above the top line T of the heel portion 1" The protruding part 4 is attached to the heel part 1, and the protruding portion 4 has first and second portion 41 and 42 on both sides, and a valley between the first peak 41 and the second mountain portion 42. 43, a first guide portion 44 that guides the heel 5 of the foot into the footwear S, a second guide portion 44 that guides the heel 5 of the foot into the footwear S, and a second guide portion 44 that guides the heel 5 of the foot into the footwear S. It is suitable for the core 40 of "footwear" in which the portions 45 are formed on the inner side X of the second mountain portion 42, respectively.

What is claimed is:

1. A footwear, comprising:

a sole portion configured to receive a bottom of a foot;

a heel portion extending from the sole portion in a first direction and configured to receive a heel of the foot;

a protruding portion extending from the heel portion in the first direction and protruding above a top line of the heel portion; and a one-piece reinforcing core having a moon-shape and extending from the sole portion to the protruding portion above the top line of the heel portion, wherein the protruding portion includes a first mountain portion, a second mountain portion, and a valley portion between the first mountain portion and the second mountain portion, the first mountain portion at a footwear inner side thereof includes a first guide portion for guiding the heel of the foot to an inside of the footwear, and the second mountain portion at a footwear inner side thereof includes a second guide portion for guiding the heel of the foot to the inside of the footwear.

2. The footwear according to claim 1, wherein the protruding portion includes a covering member covering the one-piece reinforcing core through a sponge member, the one-piece reinforcing core is provided with a core valley portion at a center of an upper end of a core body of the one-piece reinforcing core, and formed with a first mountain portion core on one side of the core valley portion, and a second mountain portion core on the other side of the core valley portion, and the one-piece reinforcing core of the protruding portion is harder than the sponge member.

3. The footwear according to claim 1, wherein the first guide portion and the second guide portion are facing each other and inclined to widen outwardly.

4. The footwear according to claim 1, wherein the first mountain portion is inclined upwardly and obliquely outward, and the second mountain portion is inclined upwardly and obliquely outward.

5. The footwear according to claim 1, wherein from a front view of the heel portion, the valley portion is positioned at a center, the first mountain portion is positioned at right, and the second mountain portion is positioned at left, and the first guide portion and the second guide portion are facing each other and inclined to widen outwardly.

6. The footwear according to claim 1, wherein the one-piece reinforcing core includes a core body having the moon-shape, the core body at an upper end thereof includes a core valley portion, at a center of the upper end, and having a shape corresponding to the valley portion of the protruding portion, a first mountain portion core, on one side of the core valley portion, having a shape corresponding to the first mountain portion of the protruding portion, and a second mountain portion core, on the other side of the core valley portion, having a shape corresponding to the second mountain portion of the protruding portion, and the first mountain portion core and the second mountain portion core face each other and inclined to widen outwardly in a second direction crossing the first direction.

7. The footwear according to claim 6, wherein the first mountain portion core is inclined obliquely outward in a third direction crossing the first direction and the second direction, and the second mountain portion core is inclined obliquely outward in the third direction.

8. The footwear according to claim 7, wherein the core body at a portion below the upper end has a shape corresponding to the heel portion.

9. The footwear according to claim 8, wherein the protruding portion includes a covering member covering the one-piece reinforcing core, and a sponge member between the one-piece reinforcing core and the covering member, and the one-piece reinforcing core is harder than the sponge member and the covering member.

* * * * *